US006164072A

United States Patent [19]

Tsiklauri et al.

[11] Patent Number: 6,164,072

[45] Date of Patent: Dec. 26, 2000

[54] METHOD AND APPARATUS FOR MATCHING A SECONDARY STEAM SUPPLY TO A MAIN STEAM SUPPLY OF A NUCLEAR OR THERMAL RENEWABLE FUELED ELECTRIC GENERATING PLANT

[75] Inventors: Georgi Tsiklauri; Robert J. Talbert; Vladimir Korolev, all of Richland, Wash.

[73] Assignee: Battelle Memorial Institute, Richland, Wash.

[21] Appl. No.: 09/178,029

[22] Filed: Oct. 21, 1998

[51] Int. Cl.[7] ..... F01K 13/00

[52] U.S. Cl. ..... 60/645; 60/676

[58] Field of Search ..... 60/645, 670, 676, 60/681

[56] References Cited

U.S. PATENT DOCUMENTS

| | | | |
|---|---|---|---|
| 3,937,024 | 2/1976 | Durrant et al. | 60/676 |
| 4,060,990 | 12/1977 | Guido et al. | 60/676 |
| 4,085,593 | 4/1978 | Larsen | 60/676 |
| 4,109,469 | 8/1978 | Carson | 60/676 |
| 5,457,721 | 10/1995 | Tsiklauri et al. . | |
| 5,526,386 | 6/1996 | Tsiklauri et al. . | |
| 5,793,831 | 8/1998 | Tsiklauri et al. . | |
| 5,850,740 | 12/1998 | Sato et al. | 60/676 |

*Primary Examiner*—Hoang Nguyen
*Attorney, Agent, or Firm*—Paul W. Zimmerman

[57] ABSTRACT

The present invention is a method and apparatus for matching a secondary steam supply to a main steam supply of a limited enthalpy steam generator when the limited enthalpy steam generator is operating at partial capacity to maintain a primary turbine at full capacity. The limited enthalpy steam generator is connected to the primary turbine with a main steam line. The method and apparatus of the present invention rely upon (a) a secondary steam line connected to the main steam line; wherein (b) the secondary steam is at a secondary steam thermodynamic state substantially matching a main steam thermodynamic state of the main steam as a combined steam; and (c) the combined steam is passed to the primary turbine at full capacity.

16 Claims, 4 Drawing Sheets

METHOD AND APPARATUS FOR MATCHING A SECONDARY STEAM SUPPLY TO A MAIN STEAM SUPPLY OF A NUCLEAR OR THERMAL RENEWABLE FUELED ELECTRIC GENERATING PLANT

FIELD OF THE INVENTION

The present invention is related to matching a secondary steam supply to a main steam supply of a nuclear or thermal renewable fueled electric generating plant.

As used herein, the term "limited enthalpy steam generator" is defined to include nuclear fueled steam generator, thermal renewable steam generator and combinations thereof.

As used herein, the term "thermal renewable" is defined to include solar thermal, geothermal and combinations thereof.

BACKGROUND OF THE INVENTION

Nuclear fueled electric generating plants and thermal renewable fueled electric generating plants of solar thermal and geothermal electric generating plants suffer from periods of partial capacity main steam supply to the primary high pressure steam turbines. It is well known that the primary high-pressure steam turbine energy efficiency suffers significantly at partial capacity or partial load.

Nuclear fueled electric generating plants including both pressurized water reactors (PWR) and boiling water reactors (BWR) are particularly sensitive to this problem because as the nuclear steam supply system, it cannot support sustained full capacity pressure and temperature due to pressure vessel embrittlement and degradation of steam generator tubing. Light water reactor (LWR) nuclear plants run on a low-pressure saturated steam cycle. The wet steam expansion engenders both low turbine efficiency and secondary plant erosion/corrosion problems. The net efficiency for a LWR is typically between 32% and 35%.

The loss of sustained full capacity of the nuclear steam generator is the result of embrittlement of reactor vessel walls within the nuclear steam generator caused by fast neutron fluence damage. Heat annealing of the vessel has been used to partially overcome the embrittlement. Clever core loading can somewhat reduce vessel wall fluence at the cost of having many central core bundles running very near, or at their operational thermal limits. Finally, the most straightforward solution has been to simply reduce the fast neutron fluence exposure of the reactor pressure vessel walls by operating the nuclear steam generator at partial capacity.

Over 400 light water reactors produce approximately 22% of the world's electrical needs, including over 100 in the U.S., about 25 units of VVER-440 in Eastern Europe and Finland that have been in operation since about 1980; 6 units in Russia and 2 units in Ukraine. Many of these reactors are nearing the end of their licensed lifetimes. These plants must either be decommissioned or re-licensed to extend their usable lifetime. In the United States, not even one operating facility has implemented any life extension option beyond partial capacity operation. One reason is that the competitive price of electricity produced with other fuels, specifically natural gas, is difficult to meet with a nuclear fueled electric generating plant. Another related reason is the lower operating temperature and pressure of nuclear fueled electric generating plants reduces thermodynamic efficiency of the Rankine steam cycle through the secondary system of the primary high pressure turbine(s). For example, LWR nuclear plants run on a low-pressure saturated steam cycle. The wet steam expansion engenders both low turbine efficiency and secondary plant erosion/corrosion problems. The net efficiency for a LWR is typically between 32% and 35%.

Attempts at compensating for reduced nuclear steam generator capacity include U.S. Pat. No. 5,457,721 to Tsiklauri et al. wherein a gas turbine provides electrical output and an exhaust gas that passes through a heat recovery boiler to generate superheated steam that flows to a mixer wherein the superheated steam is mixed with the wet main steam from the nuclear fueled steam generator. This approach of mixing superheated steam with wet steam suffers an entropy loss during the mixing. A further disadvantage is that the nuclear fueled steam generator must operate at sufficient capacity to cool the superheated steam to an enthalpy that matches the primary turbine inlet steam requirements. Thus, when the nuclear fueled steam generator falls below a certain capacity or is decommissioned, the superheated steam cannot alone power the primary turbine.

For solar thermal applications, the solar input to a steam generator is only at full capacity during the heat of the day. During the rest of the day, solar input and therefore solar therma steam generator output is at partial capacity requiring either expensive thermal storage or operation of the primary turbine at partial capacity.

For geothermal applications, the steam is generally not superheated and in certain instances flow rate may vary to a partial capacity.

Hence, there is a need for a method and apparatus that would enable full electric generating capacity of the secondary turbine generator portion of aging nuclear power plants as well as full capacity electrical generating capacity of thermal renewable power plants.

SUMMARY OF THE INVENTION

The present invention is a method and apparatus for substantially matching a secondary steam supply to a main steam supply of a limited enthalpy steam generator when the limited enthalpy steam generator is operating at partial capacity to maintain a primary turbine at full capacity. The limited enthalpy steam generator is connected to the primary turbine with a main steam line. The method and apparatus of the present invention rely upon (a) a secondary steam line connected to the main steam line; wherein (b) the secondary steam is at a secondary steam thermodynamic state substantially matching a main steam thermodynamic state of the main steam as a combined steam; and (c) the combined steam is passed to the primary turbine at full capacity.

Limited enthalpy steam generators include nuclear fueled steam generators, either PWR or BWR, land based or mobile (e.g. ship based), thermal renewable including solar thermal and geothermal steam generators.

The present invention advantageously allows operation of the limited enthalpy steam generator at any level of partial capacity while maintaining the primary turbine at full capacity. For nuclear fueled steam generators, the nuclear fueled steam generator may continue to be used at ever decreasing capacity until it is decided to decommission it. The secondary steam may continue to be used to operate the primary turbine. Another advantage of the present invention is that because the secondary steam thermodynamic state substantially matches the main steam thermodynamic state no mixer is needed and there is substantially no entropy loss upon combining the secondary steam with the main steam.

It is an object of the present invention to provide a method and apparatus for substantially matching a secondary steam supply to a main steam supply of a limited enthalpy steam generator when the limited enthalpy steam generator is operating at partial capacity to maintain a primary turbine at full capacity.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DESCRIPTION OF THE PREFERRED EMBODIMENT(S)

Figure 1A:
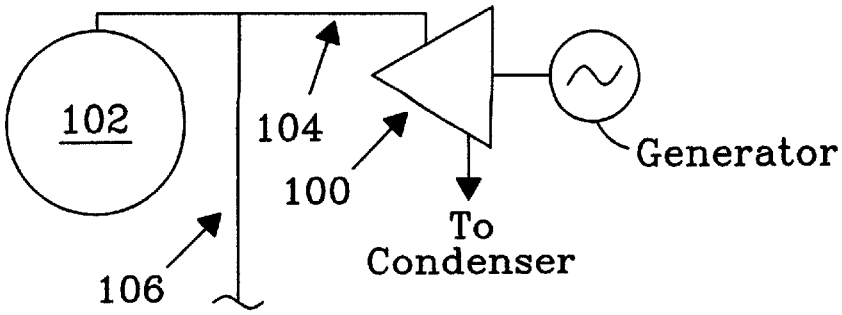
FIG. 1*a* is a diagram of the present invention of a secondary steam combined with a main steam of a limited enthalpy steam generator.
Figure 2A:
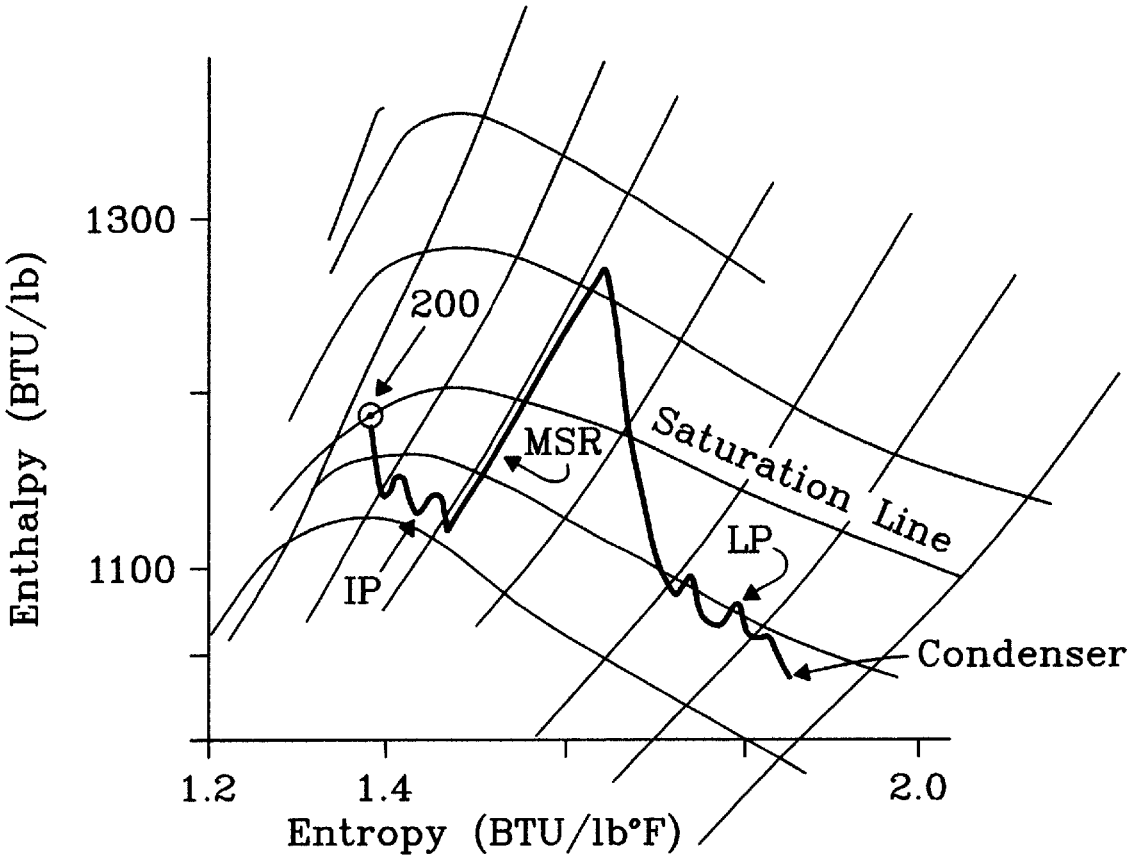
FIG. 2*a* is a Mollier diagram of a nuclear steam cycle.
Figure 1B:
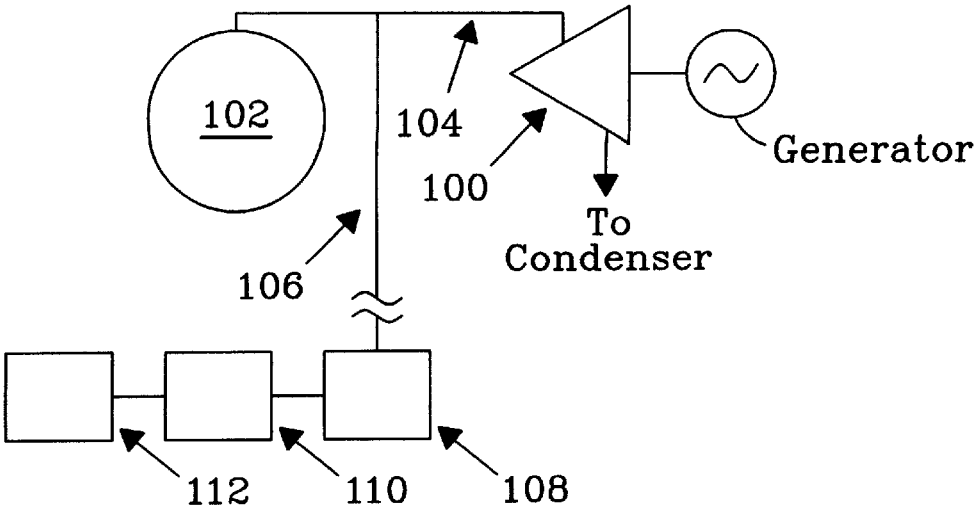
FIG. 1*b* is the same as FIG. 1, but adding alternative secondary steam sources.

The present invention (FIG. 1*a*) overcomes the problem of maintaining a primary turbine 100 at full capacity when a limited enthalpy steam generator 102 is operating at partial capacity. Full capacity of a primary turbine is herein defined as preferably greater than or equal to 80% of design capacity, more preferably greater than or equal to 90% of design capacity, and most preferably greater than or equal to 95% of design capacity. Full capacity also encompasses operation above design capacity up to about 10% or the limitation of the electrical generator. A main steam line 104 connects the limited enthalpy steam generator 102 to the main turbine 100. The method and apparatus of the present invention rely upon (a) a secondary steam line 106 connected to the main steam line 104; wherein (FIG. 2*a*) (b) the secondary steam is at a secondary steam thermodynamic state 200 substantially matching a main steam thermodynamic state 200 of the main steam as a combined steam; and (c) the combined steam is passed to the primary turbine 100 at full capacity. As shown in FIG. 1*b*, the secondary steam may be provided from a steam source 108 selected from the group consisting of fossil fuel, combustion exhaust, secondary steam turbine exhaust and combinations thereof.

In a first embodiment according to the present invention is to generate steam that is saturated or slightly superheated steam from a fossil fuel, for example from the exhaust heat of the Brayton cycle gas turbine. This steam substantially matches the thermodynamic state of the main steam. This embodiment provides a low capital cost for a combined cycle installation. The efficiency of this embodiment is from about 40% to about 44% thermal efficiency.

Figure 2B:
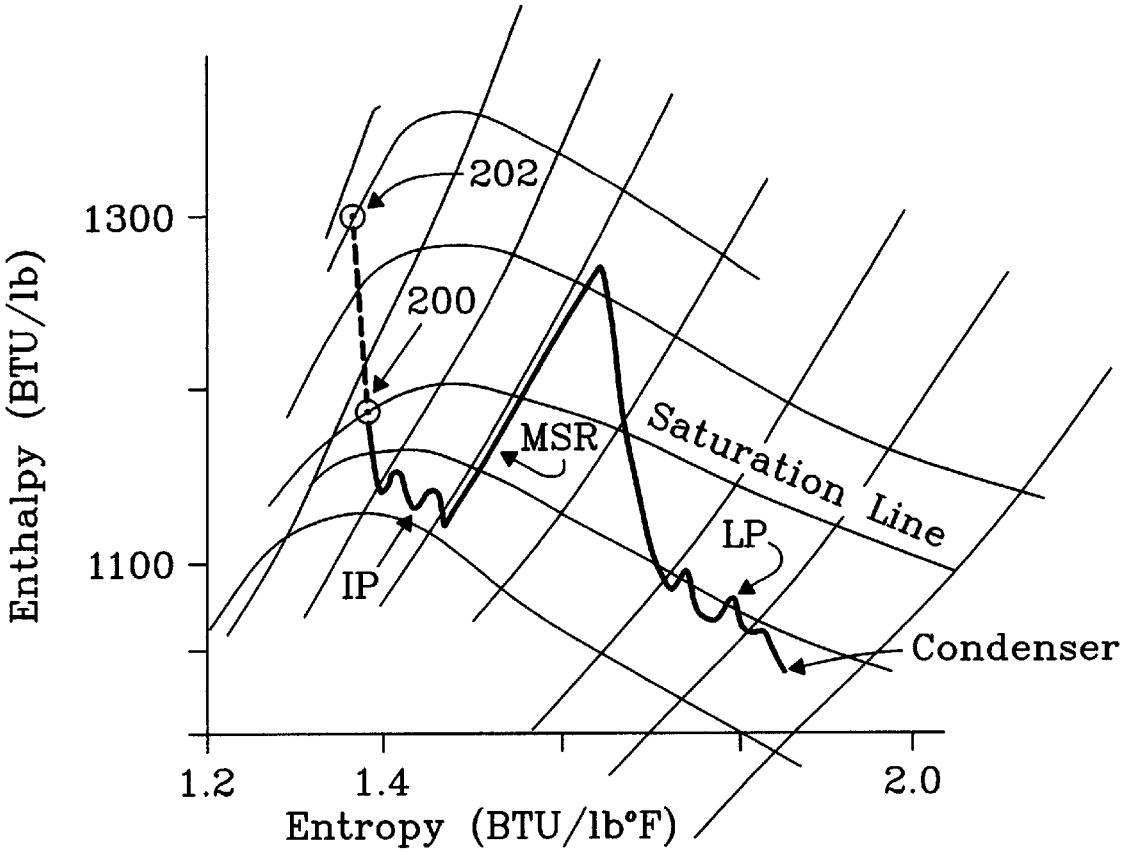
FIG. 2*b* is a Mollier diagram of a combined cycle according to the present invention.

In a preferred embodiment, the steam source 108 is a secondary steam turbine and the secondary steam is the exhaust from the secondary steam turbine. Further, a secondary steam supply to the secondary steam turbine is from a secondary steam generator 110. A secondary steam generator heat source 112 is selected from the group consisting of fossil fuel, combustion exhaust and combinations thereof. It is preferred that the secondary steam generator heat source 112 is combustion exhaust is from a Brayton cycle turbine. Thus, for the preferred embodiment, referring to FIG. 2*b*, exhaust from the Brayton cycle turbine 112 produces steam from the secondary steam generator 110 that is superheated 202 (FIG. 2*b*), whereupon passing through the secondary steam turbine 108 extracts work and exhausts at a thermodynamic state substantially matching the thermodynamic state 200 of the main steam. Substantially matching means that on a Mollier diagram, the enthalpy of the secondary steam is within about 2% of the enthalpy of the main steam, preferably within about 1%, and the entropy of the secondary steam is within about 2% of the entropy of the main steam, preferably within about 1%.

Figure 1C:
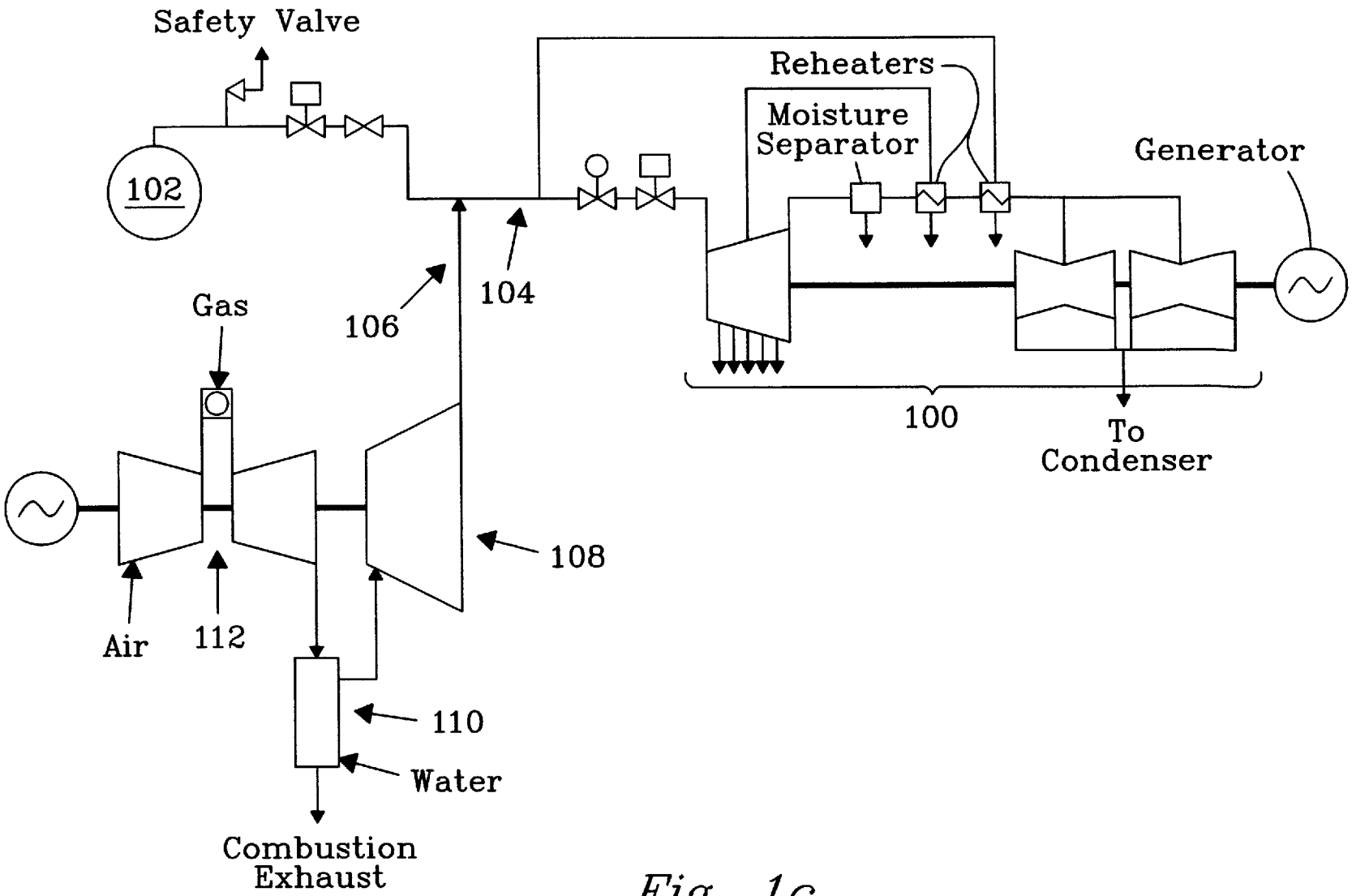
FIG. 1*c* is a more detailed schematic of the preferred embodiment.

A more detailed diagram of the preferred embodiment is shown in FIG. 1*c*.

Estimated performance of the combined cycle of the preferred embodiment is from about 44% to about 48% efficiency. Because the coupling of the secondary steam 106 with the main steam 104 occurs at substantially the same thermodynamic state, there is no need for mixer(s), there is no need for modification of the nuclear steam cycle, including the main steam turbines, piping, and auxiliaries. Because the primary steam turbine 100 operates at full nominal power as secondary steam is directed the main steam, the reactor steam supply, and hence reactor power, can be decreased in steps to any desired level by increasing the capability of the gas turbine heat recovery steam generator 110. This permits full capacity use of the primary steam turbine 100 during (1) reactor (nuclear steam generator) operating at partial capacity(ies) for extended periods, (2) decommissioning of the nuclear reactor, or (3) intermittent outage of the nuclear reactor.

The Brayton cycle gas turbine 112 that may be used include the standard type available from manufacturers such as General Electric, Siemens, and ASEA Brown Boveri (ABB). It is preferred that the heat recovery steam generator 110 have a single pressure supercritical steam state 202, which after passing through the secondary turbine 108 provides a secondary steam that substantially matches the main steam thermodynamic state 200. These conditions of supercritical pressure steam generation provide the additional advantage of enhanced heat transfer in the heat recovery steam generator 110, without pinch points. Another advantage is the possibility to generate approximately 8~10% more steam from the same amount of waste heat due to the difference in latent heat at supercritical conditions.

For nuclear steam generators, advantages of the present invention include life extension made possible by greatly reducing the fast neutron flux (and fluence) at the reactor vessel walls. This is accomplished by keeping the center of the core at near normal operating bundle powers and significantly reducing the bundle powers in the first few rows of the periphery of the core. During refueling outages, dummy bundles can be used as replacements for actual fuel bundles on the periphery, making the flux and fluence reduction at the reactor vessel walls even greater. Safety is not impacted by this action. Moreover, a nuclear generating station may enter the end-of-life period without undue economic burden on the utility. Normally, decommissioning enters a phase of large capital outlay by the utility without any generation from the plant to be sold. With the present invention, a utility may gradually add more gas turbines and heat recovery steam generator modules and continue to supply full steam demand to the installed primary turbine while reducing reactor power and main steam flow. This avails a strategy that will allow a gradual transition of the station to a full combined cycle gas configuration. The station continues to market electricity at a profit while commencing the reactor-decommissioning phase.

A small additional benefit is gleaned during the decommissioning transition phase. At partial reactor powers, due to steam conditions, the nuclear efficiency is slightly enhanced. The secondary system (primary steam turbine 100) is fully operational with all feed water heaters in full-flow operation. The steam generator 102 is operating at the same hot leg temperature, but at a higher cold leg temperature which slightly enhances efficiency of the reactor system.

No primary plant (nuclear) systems are required once a full transition to combined cycle gas has been accomplished. Further, this transition can be carried out over many years, allowing recovery of the majority of the capital cost of the gas turbines and heat recovery steam generators. While the cost of nuclear decommissioning is encountered, profit from electricity sales from installed equipment continues.

Nuclear safety is enhanced in all transition configurations. The reactor operates at reduced power levels. The instantaneous decay heat is reduced, assuaging the peak cladding temperature reached during all loss of coolant accident (LOCA) conditions, both small and large break. The reduction of decay heat also reduces the containment heat load post LOCA. A reduction of total core fission product inventory reduces the reactor source term during accident conditions that could foster a release. More time is availed during station blackout conditions due to the reduced decay heat production. Virtually all emergency core-cooling systems (ECCS) become significantly over designed due to reduced fission product inventory. The consequences of most reactivity transients are assuaged in that they commence from a lower power level. Rod eject (PWR) and rod drop (BWR) transients remain unchanged, in that limiting conditions for the accident are critical, hot, zero-power.

EXAMPLE 1

Figure 3:
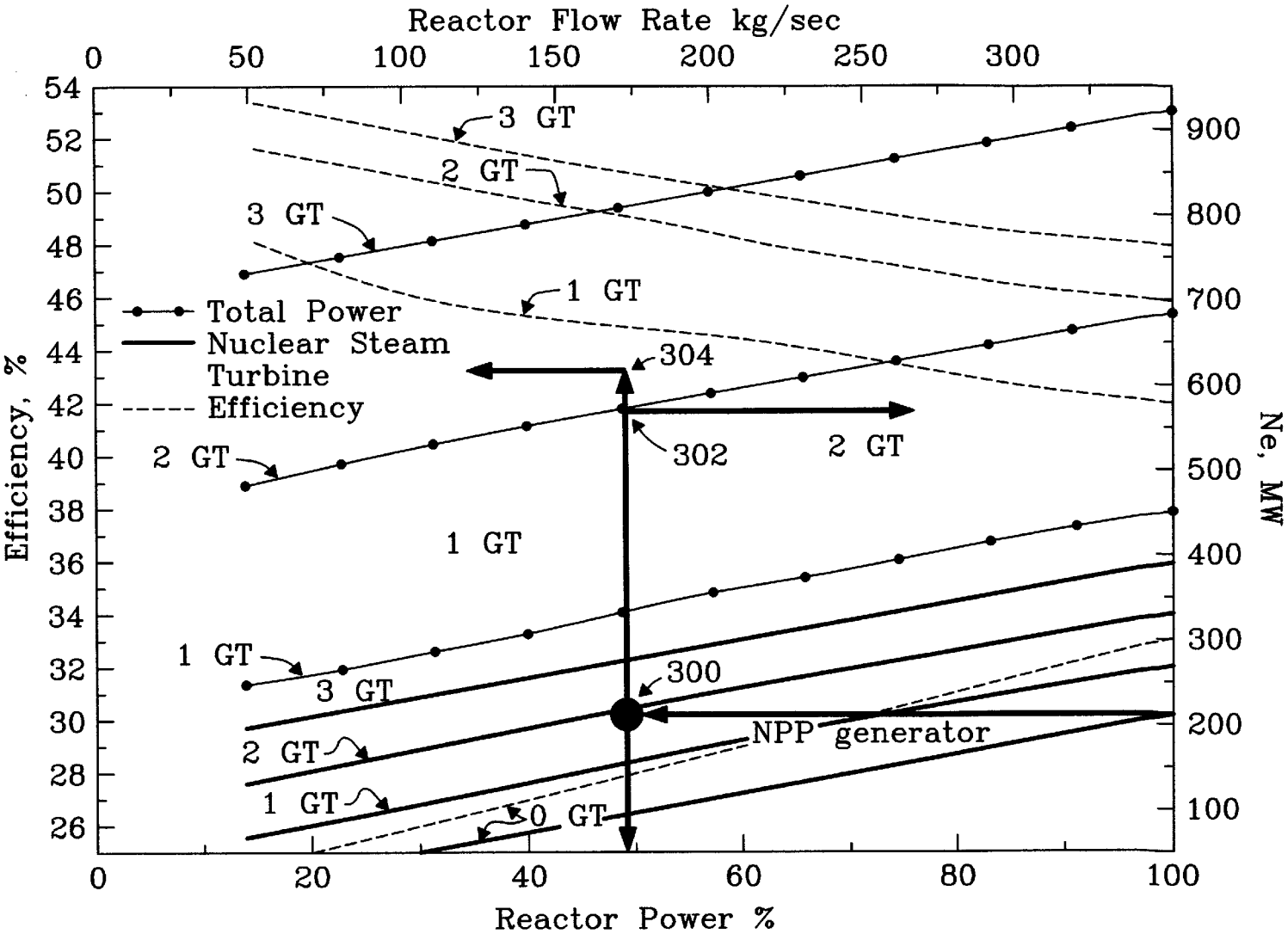
FIG. 3 is a graph permitting selection of system operating points.

Calculations for a VVER plant have demonstrated improved efficiency according to the present invention. In FIG. 3, GT means Gas Turbine, and 0-GT means nuclear alone without a gas turbine. The solid lines with solid circles are the total electrical power output of the sum of the main steam turbine 100 and the Brayton cycle turbine 112. The solid lines are the electrical power output of the main steam turbine 100. The dashed lines are the total efficiency of the combined cycle system.

FIG. 3 shows that nuclear plant gross efficiency without gas turbines decreases from 33.9% at 100 percent power (215 MW) to 25% efficiency at 20 percent reactor power [see curve marked (0-GT) The efficiency of the intermediate pressure turbine is decreased at the decreased steam flow.

The curve for zero gas turbines (nuclear only) trends down with decreasing reactor power, while curves for one, two, or three gas turbines show an increase of efficiency with decreasing reactor power. With two or more gas turbines, the efficiency curves show a continuous upward trend with decreasing reactor power. Calculations with 2 ABB CT24 (UF) gas turbines show a plant efficiency of 49% at ~50 percent reactor power which is much higher than the full power efficiency value for a WER-440 plant without gas turbines. Plant efficiency at ~60 percent of reactor power is calculated to be 42.5% if one ABB supplementary-fired gas turbine is used.

Thus, supplementing existing nuclear power plant WER-440/213 designs running at reduced reactor thermal power is prudent.

In FIG. 3, the large point 300 at about 50 percent of WER-440 reactor power with two GT (VF) is positioned near the 200 MW output. Beginning on the right at 100% reactor power then moving to the left toward the large point 300 illustrates several options for the WER-400 plant.

Option 1 (point 302) The plant consists of a WER-440 operating at 62 percent of thermal power, two units ABB GT24 (SF) plus steam turbines, generating 370 MWe. The nuclear steam turbine generates a nominal power of 430.4 MWe. Thermal efficiency of the combined cycle is 42.1% and the total power of the station is practically doubled.

Option 2 (point 304) The plant is a more efficient power generating system with a thermal efficiency of 49.3% and a total power of 1,160 MWe. The configuration consists of four unfired gas turbines. Capital cost of Option 2 will be higher than for Option 1.

Option 3 (Not shown in FIG. 3) This option is a decommission option. The reactor thermal power is only 20 percent and a nuclear power plant VVER-440 is practically replaced by four combined cycle gas turbines.

CLOSURE

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A method of operating a limited enthalpy steam generator providing main steam at a partial capacity while maintaining a primary turbine at full capacity, said limited enthalpy steam generator connected to said primary turbine with a main steam line, the method comprising the steps of:

(a) connecting a secondary steam line from an electricity generating steam source to said main steam line;

(b) providing secondary steam at a entropy and enthalpy matching the entropy and enthalpy of said main steam as a combined steam; and (c) passing said combined steam to said primary turbine at full capacity.

2. The method as recited in claim 1, wherein said providing of said secondary steam is with a steam source selected from the group consisting of fossil fuel, combustion exhaust, secondary steam turbine exhaust and combinations thereof.

3. The method as recited in claim 1, wherein said combustion exhaust is from a Brayton cycle turbine.

4. The method as recited in claim 2, wherein said secondary steam turbine exhaust is said secondary steam.

5. The method as recited in claim 4, wherein a secondary steam supply to a secondary steam turbine is from a secondary steam generator.

6. The method as recited in claim 5, wherein said secondary steam generator heat source is selected from the group consisting of fossil fuel, combustion exhaust and combinations thereof.

7. The method as recited in claim 6, wherein said combustion exhaust is from a Brayton cycle turbine.

8. The method as recited in claim 6, wherein said secondary steam is superheated in advance of the secondary turbine.

9. An apparatus for operating a limited enthalpy steam generator providing main steam at a partial capacity while maintaining a primary turbine at full capacity, said limited enthalpy steam generator connected to said primary turbine with a main steam line, the apparatus comprising:

(a) a secondary steam line from an electricity generating steam source connected to said main steam line; wherein secondary steam from said secondary steam line having a entropy and enthalpy substantially matching the entropy and enthalpy of said main steam is added to a main steam as a combined steam; and (b) a primary turbine that receives said combined steam at full capacity of the primary turbine.

10. The apparatus as recited in claim 9, wherein said secondary steam is from a steam source selected from the group consisting of fossil fuel, combustion exhaust, secondary steam turbine exhaust and combinations thereof.

11. The apparatus as recited in claim 10, wherein said combustion exhaust is from a Brayton cycle.

12. The apparatus as recited in claim 10, wherein said secondary steam turbine exhaust is said secondary steam.

13. The apparatus as recited in claim 12, wherein a secondary steam supply to a secondary steam turbine is from a secondary steam generator.

14. The apparatus as recited in claim 13, wherein said secondary steam generator heat source is selected from the group consisting of fossil fuel, combustion exhaust and combinations thereof.

15. The apparatus as recited in claim 14, wherein said combustion exhaust is from a Brayton cycle turbine.

16. The apparatus as recited in claim 14, wherein said secondary steam is superheated in advance of the secondary turbine.

* * * * *